US011110998B2

(12) United States Patent
Kruts et al.

(10) Patent No.: US 11,110,998 B2
(45) **Date of Patent: *Sep. 7, 2021**

(54) INLINE ASPIRATOR FOR INFLATABLE ASSEMBLIES

(71) Applicant: GOODRICH CORPORATION, Charlotte, NC (US)

(72) Inventors: Ivan Kruts, Sacramento, CA (US); Drew Hartman, Phoenix, AZ (US)

(73) Assignee: Goodrich Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/852,031

(22) Filed: Apr. 17, 2020

(65) Prior Publication Data

US 2020/0239115 A1 Jul. 30, 2020

Related U.S. Application Data

(63) Continuation of application No. 16/048,643, filed on Jul. 30, 2018, now Pat. No. 10,661,865.

(51) Int. Cl.

| | |
|---|---|
| ***B63C 9/04*** | (2006.01) |
| ***B63C 9/00*** | (2006.01) |
| ***B63C 9/22*** | (2006.01) |
| *B63C 9/01* | (2006.01) |

(52) U.S. Cl.

CPC ..... *B63C 9/04* (2013.01); *B63C 9/00* (2013.01); *B63C 9/22* (2013.01); *B63C 9/01* (2013.01); *B63C 2009/0035* (2013.01); *B63C 2009/042* (2013.01)

(58) Field of Classification Search

CPC .... B63C 9/00; B63C 9/01; B63C 9/04; B63C 9/22; B63C 2009/0035; B63B 35/00; B63B 35/58; B01F 3/02; B01F 5/04; F04F 5/00; F04F 5/48

USPC ..... 441/41, 42; 417/54, 183, 184, 187, 189, 417/191

See application file for complete search history.

(56) References Cited

U.S. PATENT DOCUMENTS

| | | | |
|---|---|---|---|
| 3,591,314 | A | 7/1971 | Day |
| 3,598,504 | A | 8/1971 | Siravo |
| 3,684,404 | A | 8/1972 | Galbraith |
| 4,362,517 | A | 12/1982 | Martin |
| 4,566,862 | A | 1/1986 | Halavais |
| 5,566,728 | A | 10/1996 | Lange |
| 6,071,084 | A | 6/2000 | Wass |

(Continued)

OTHER PUBLICATIONS

USPTO; Non-Final Office Action dated Jun. 28, 2019 in U.S. Appl. No. 16/048,643.

(Continued)

*Primary Examiner* — Lars A Olson

(74) *Attorney, Agent, or Firm* — Snell & Wilmer L.L.P.

(57) ABSTRACT

An inline for an inflatable assembly may comprise a first end defining a primary gas inlet and a second end defining a primary gas outlet. An internal surface may define a flow path extending from the primary gas inlet to the primary gas outlet. An orifice may be located between the first end and the second end. The orifice may be defined, at least partially, by a radial wall extending from the internal surface to the external surface. The orifice may be configured to entrain ambient air with a primary gas flowing from the primary gas inlet to the primary gas outlet.

18 Claims, 4 Drawing Sheets

(56) References Cited

U.S. PATENT DOCUMENTS

| | | | | |
|---|---|---|---|---|
| 6,494,756 | B2 | 12/2002 | Michaud et al. | |
| 7,527,481 | B2 | 5/2009 | Baryshnikov et al. | |
| 8,549,850 | B2 | 10/2013 | Janakiraman et al. | |
| 8,550,137 | B2 | 10/2013 | Delgado et al. | |
| 9,585,425 | B2 | 3/2017 | Berchten et al. | |
| 10,661,865 | B2 * | 5/2020 | Kruts | B63C 9/22 |

OTHER PUBLICATIONS

USPTO; Final Office Action dated Oct. 23, 2019 in U.S. Appl. No. 16/048,643.
USPTO; Notice of Allowance dated Jun. 28, 2019 in U.S. Appl. No. 16/048,643.

* cited by examiner

INLINE ASPIRATOR FOR INFLATABLE ASSEMBLIES

CROSS-REFERENCE TO RELATED APPLICATIONS

This application is a continuation of, and claims priority to, U.S. Ser. No. 16/048,643, filed Jul. 30, 2018 and titled "INLINE ASPIRATOR FOR INFLATABLE ASSEMBLIES," which is hereby incorporated by reference in its entirety for all purposes.

FIELD

The present disclosure relates to inflatable assemblies and, in particular, to inline aspirators for inflatable assemblies.

BACKGROUND

In the event of an emergency water landing, aircraft typically have one or more life rafts that can be deployed to hold evacuated passengers. To inflate the life raft, gas is transferred from a cylinder containing air or carbon dioxide or a mixture of gases stored at high-pressure to the inflatable tubes of the life raft. Larger cylinders may be employed to decrease inflation time; however, larger cylinders increase weight and require more storage space.

SUMMARY

An inline aspirator for an inflatable assembly is disclosed herein. In accordance with various embodiments, the inline aspirator may comprise a first end defining a primary gas inlet, and a second end defining a primary gas outlet. An internal surface may define a flow path extending from the primary gas inlet to the primary gas outlet. An external surface may be opposite the internal surface. An orifice may be located between the first end and the second end. The orifice may be defined, at least partially, by a radial wall extending from the internal surface to the external surface. The orifice may be configured to entrain ambient air with a primary gas flowing from the primary gas inlet to the primary gas outlet.

In various embodiments, the internal surface may define a choke, a convergent section upstream of the choke, and a divergent section downstream of the choke. In various embodiments, a first diameter of the internal surface upstream of the convergent section may be equal to a second diameter of the internal surface downstream of the divergent section.

In various embodiments, an air outlet of the orifice may be located proximate the choke. In various embodiments, the air outlet may be located at a transition from the choke to the divergent section.

In various embodiments, the inline aspirator may further comprise a first portion including the first end, and a second portion downstream of the first portion including the second end. A spring may be coupled between the first portion and the second portion. In various embodiments, a stopper may be attached to the first portion. The stopper may be located within a volume defined by the second portion. The stopper may be configured to restrict translation of the second portion away from the first portion after a predetermined distance.

In various embodiments, the radial wall may be sloped such that an upstream portion of the radial wall is radially outward of a downstream portion of the radial wall.

A life raft assembly is also disclosed herein. In accordance with various embodiments, the life raft may comprise an inflatable raft and a charge cylinder fluidly coupled to the inflatable raft. An inline aspirator may be fluidly coupled between the inflatable raft and the charge cylinder.

In various embodiments, the inline aspirator may comprise an internal surface defining a flow path extending from a first end of the inline aspirator to a second end of the inline aspirator. An orifice may be located between the first end and the second end. The orifice may be defined, at least partially, by a radial wall extending from the internal surface to an external surface opposite the internal surface. The orifice may be configured to entrain ambient air with a primary gas output from the charge cylinder.

In various embodiments, the internal surface may define a choke, a convergent section upstream of the choke, and a divergent section downstream of the choke. In various embodiments, an air outlet of the orifice may be located downstream of the choke. In various embodiments, the air outlet may be located at a transition from the choke to the divergent section.

In various embodiments, a conduit may be fluidly coupled to the first end of the inline aspirator and the charge cylinder. An internal surface of conduit may be coplanar with the internal surface of the inline aspirator.

In various embodiments, the inline aspirator may comprise a first portion and a second portion downstream of the first portion. A spring may be coupled between the first portion and the second portion.

An inflatable assembly is also disclosed herein. In accordance with various embodiments, the inflatable assembly may comprise an inflatable structure and a charge cylinder fluidly coupled to the inflatable structure. An inline aspirator may be fluidly coupled between the inflatable structure and the charge cylinder.

In various embodiments, the inline aspirator may comprise an internal surface defining a flow path extending from a first end of the inline aspirator to a second end of the inline aspirator. An orifice may be located between the first end and the second end. The orifice may be defined, at least partially, by a radial wall extending from the internal surface to an external surface opposite the internal surface. The orifice may be configured to entrain ambient air with a primary gas output from the charge cylinder.

In various embodiments, the internal surface may define a convergent section and a divergent section. In various embodiments, the radial wall may be sloped such that an upstream portion of the radial wall is radially outward of a downstream portion of the radial wall.

In various embodiments, the inline aspirator may comprise a first portion and a second portion downstream of the first portion. A spring may be coupled between the first portion and the second portion.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the exemplary embodiments of the disclosure, it should be understood that other embodiments may be realized and that logical changes and adaptations in design and construction may be made in accordance with this disclosure and the teachings herein. Thus, the detailed description herein is presented for purposes of illustration only and not limitation. The steps recited in any of the method or process descriptions may be executed in any order and are not necessarily limited to the order presented.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option.

Surface cross hatching lines may be used throughout the figures to denote different parts but not necessarily to denote the same or different materials. Throughout the present disclosure, like reference numbers denote like elements. Accordingly, elements with like element numbering may be shown in the figures, but may not necessarily be repeated herein for the sake of clarity.

In the context of the present disclosure, methods, systems, and articles may find particular use in connection with life raft assemblies. However, various aspects of the disclosed embodiments may be adapted for performance in a variety of other inflatable assemblies. As such, numerous applications of the present disclosure may be realized.

Figure 1:
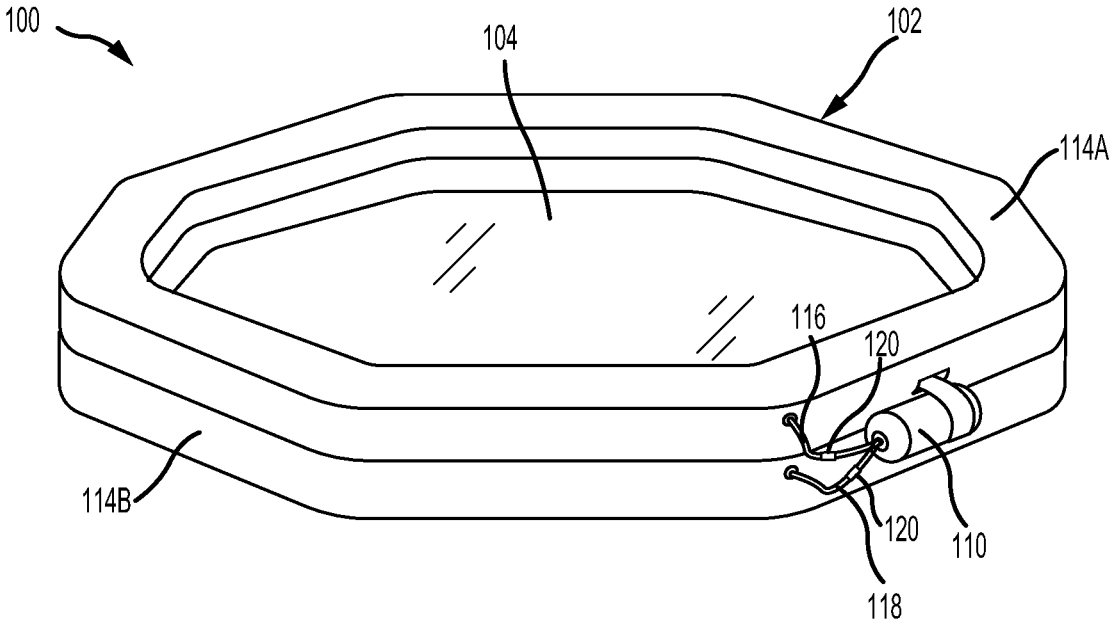
FIG. 1 illustrates a perspective view of a life raft in a deployed or inflated state, in accordance with various embodiments.

In accordance with various embodiments, and with reference to FIG. 1, a life raft assembly 100 is illustrated in a deployed, or inflated, state. Life raft assembly 100 includes an inflatable structure 102. In various embodiments, inflatable structure 102 comprises an inflatable life raft. Inflatable structure 102 may comprise a flexible, waterproof material such as a polyurethane polymer, polyvinylchloride polymer, or other suitable polymer. Inflatable structure 102 may comprise a base 104 configured to support passengers and separate passengers from a body of water while inflatable structure 102 is in operation. Inflatable structure 102 may include one or more inflatable border tubes 114A, 114B. Inflatable border tubes 114A, 114B may provide buoyancy to the inflatable structure 102 and may be mounted one on the other. Inflatable border tubes 114A, 114B may provide a degree of buoyancy redundancy in that each border tube may be independently capable of supporting the weight of life raft assembly 100 when filled to capacity with passengers. Inflatable border tubes 114A, 114B may circumscribe the base 104. In various embodiments, inflatable structure 102 may generally comprise a hexagonal shape. That is, inflatable border tube 114A and inflatable border tube 114B may define a hexagonal shape. However, inflatable structure 102 may generally comprise a circular shape, a rectangular shape, a pentagonal shape, an octagonal shape, or any other desired shape.

In various embodiments, life raft assembly 100 may include a compressed fluid source or charge cylinder 110. Charge cylinder 110 may be fluidly coupled to the one or more inflatable border tubes 114A, 114B. Charge cylinder 110 may be configured to deliver air and/or other gas into the one or more inflatable border tubes 114A, 114B. In various embodiments, charge cylinder 110 may be fluidly coupled to inflatable border tube 114A via a hose or conduit 116, and to inflatable border tube 114B via a hose or conduit 118. In various embodiments, each inflatable border tube may have a dedicated charge cylinder such that a first charge cylinder is fluidly coupled to inflatable border tube 114A and a second charge cylinder is fluidly coupled to inflatable border tube 114B.

Life raft assembly 100 may further include one or more inline aspirator(s) 120 fluidly coupled between charge cylinder 110 and inflatable border tubes 114A, 114B, (e.g., fluidly coupled to conduits 116, 118). As discussed in further detail below, inline aspirators 120 may be configured to entrain ambient air with gas output from charge cylinder 110 (referred to herein as primary gas). For example, in response to deployment of life raft assembly 100, primary gas from charge cylinder 110 may flow into inline aspirators 120 at a relatively high velocity. This primary gas flow may cause inline aspirators 120 to draw in a secondary gas (i.e., ambient air) from the environment. The primary gas flow and the environmental gas may be directed into inflatable border tubes 114A, 114B. In response to receiving the primary gas and the environmental gas, inflatable border tubes 114A, 114B begin to inflate. Inline aspirators 120 may increase inflation efficiency and/or decrease inflation time of inflatable structure 102. For example, inline aspirators 120 may allow the desired inflatable border tube 114A, 114B pressures to be achieved using less gas from charge cylinder 110. Accordingly, life raft assemblies having inline aspirators 120 may employ smaller charge cylinders. Decreasing charge cylinders size can reduce an overall weight and volume of the life raft assembly.

Figure 2:
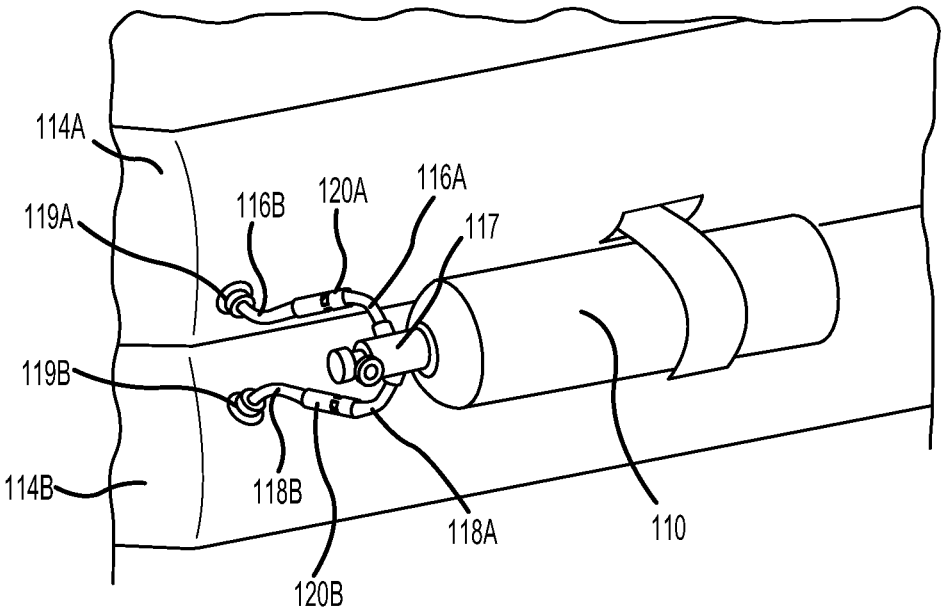
FIG. 2 illustrates a perspective view of an inline aspirator located between a charge cylinder and an inflatable life raft, in accordance with various embodiments.

In accordance with various embodiments and with reference to FIG. 2, life raft assembly 100 may include a first inline aspirator 120A located between a first conduit portion 116A and a second conduit portion 116B of conduit 116. First conduit portion 116A may be fluidly coupled to an outlet 117 of charge cylinder 110 and first inline aspirator 120A. Second conduit portion 116B may be fluidly coupled to an inlet 119A of inflatable border tube 114A and first inline aspirator 120A. A second inline aspirator 120B may be located between a first conduit portion 118A and a second conduit portion 118B of conduit 118. First conduit portion 118A may be fluidly coupled to outlet 117 of charge cylinder 110 and second inline aspirator 120B. Second conduit portion 118B may be fluidly coupled to an inlet 119B of inflatable border tube 114B and second inline aspirator 120B.

Figure 3A:
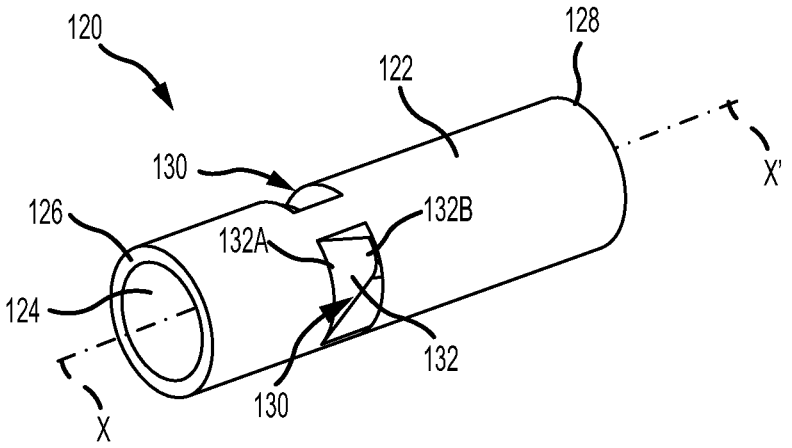
FIG. 3A illustrates a perspective view of an inline aspirator, in accordance with various embodiments.

With reference to FIG. 3A, an inline aspirator 120 is illustrated, in accordance with various embodiments. Inline aspirator 120 may include an external, or radially outward, surface 122 and an internal, or radially inward, surface 124. Inline aspirator 120 includes a first (inlet) end 126 defining a primary gas inlet, and a second (outlet) end 128 defining a primary gas outlet. When inline aspirator 120 is in an installed state, inlet end 126 is upstream of outlet end 128. For example and with combined reference to FIG. 2 and FIG. 3A, in various embodiments, inlet end 126 is coupled to first conduit portion 116A of conduit 116 and receives primary gas from charge cylinder 110. Outlet end 128 is coupled to second conduit portion 116B and outputs primary gas and ambient air entrained with the primary gas to inlet 119A of inflatable border tube 114A. Inline aspirator 120 may comprise a generally cylindrical shape, with external surface 122 and internal surface 124 oriented about a central axis X-X' extending from inlet end 126 to outlet end 128. External surface 122 is oriented away from the central axis X-X' of inline aspirator 120, and internal surface 124 is oriented toward central axis X-X'. Outlet end 128 is located axially opposite inlet end 126.

Inline aspirator 120 further includes one or more orifices 130. Orifices 130 are configured to entrain ambient air with gas flowing through inline aspirator 120. Stated differently, air located radially outward of external surface 122 may flow through orifices 130 and mix with gas located radially inward of internal surface 124. Orifices 130 are each defined by one or more radial walls 132. Radial walls extend completely through inline aspirator, such that the inlet of orifices 130 (i.e., where ambient air enters orifices 130) is located at external surface 122 and the outlet of orifices 130 (i.e., where ambient air exits orifices 130) is located at internal surface 124.

Figure 3B:
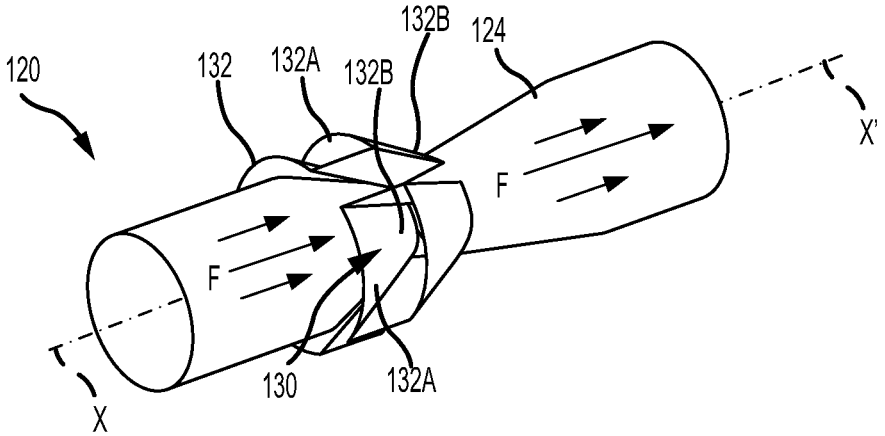
FIG. 3B illustrates the surfaces defining a flow path through the inline aspirator of FIG. 3A, in accordance with various embodiments.

With reference to FIG. 3B, internal surface 124 and a gas flow path F through inline aspirator 120 are illustrated, in accordance with various embodiments. Gas flow path F is defined by internal surface 124 of inline aspirator 120. Radial walls 132 may be sloped such that an upstream portion 132A of each radial wall 132 is a radially outward from a downstream portion 132B of the radial wall 132 (i.e., upstream portion 132A is a greater distance from central axis X-X' than downstream portion 132B). Stated differently, the radially outward portion of each radial wall 132 may be closer to inlet end 126, with momentary reference to FIG. 3A, as compared to the radially inward portion of the radial wall 132. The slope of radial walls 132 is configured such the ambient air flowing through orifices 130 enters the flow path F, defined by internal surface 124, with a streamwise directional component, which promotes integration of the ambient air into the gas flow.

Figure 4:
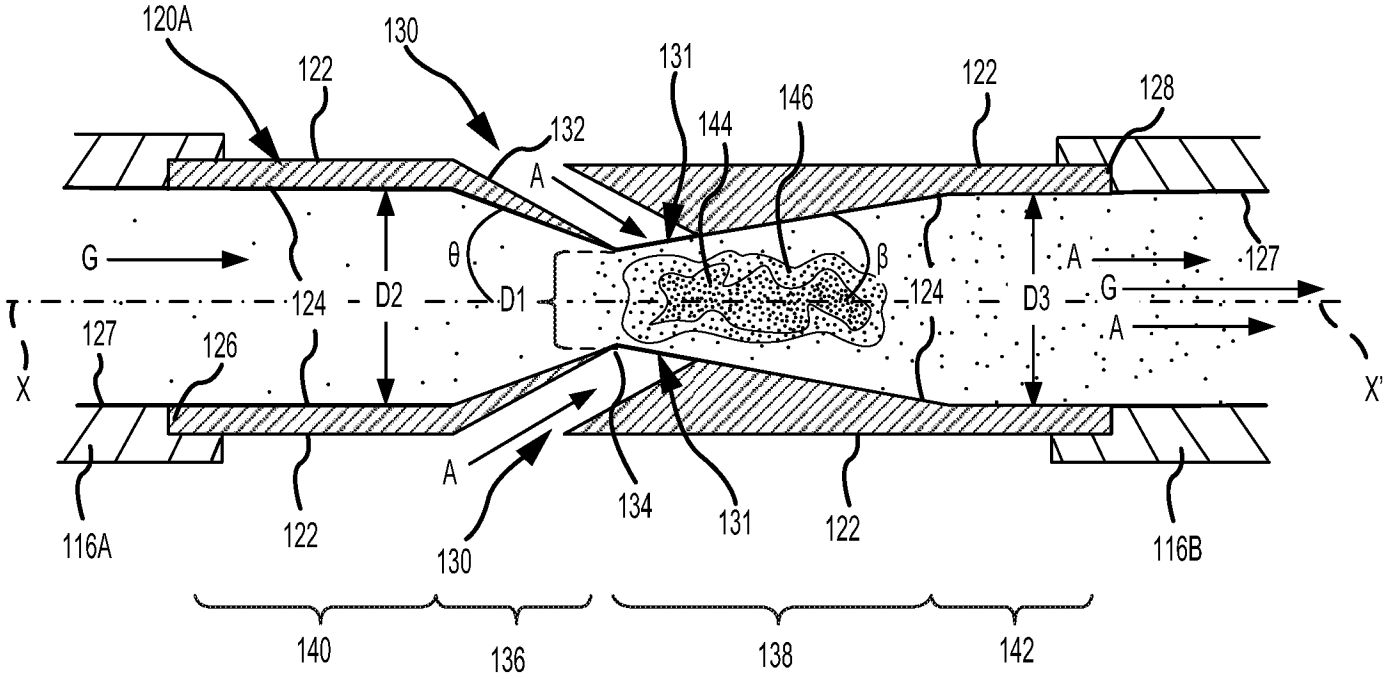
FIG. 4 illustrates flow velocity through an inline aspirator, in accordance with various embodiments.

Referring to FIG. 4, a diagram of flow velocity through inline aspirator 120A is illustrated, in accordance with various embodiments. Inlet end 126 of inline aspirator 120A is coupled to first conduit portion 116A, and outlet end 128 is coupled to second conduit portion 116B. In various embodiments, external surface 122 may define a threading configured to engage with a threading on first conduit portion 116A and second conduit portion 116B. In various embodiments, internal surface 124 may define a threading configured to engage with a threading on first conduit portion 116A and second conduit portion 116B. In various embodiments, inlet end 126 may be press fit into first conduit portion 116A and outlet end 128 may be press fit into second conduit portion 116B. Inlet end 126 and outlet end 128 may also be secured to first conduit portion 116A and second conduit portion 116B, respectively, by a clamp, band, clip, or any other mechanism capable of forming a fluid coupling between inline aspirator 120A and conduit 116. Inline aspirator 120 and conduit 116 are configured such that, when inline aspirator 120 is coupled to conduit 116, there is a smooth transition between an internal surface 127 of conduit 116 and internal surface 124 of inline aspirator 120A. Stated differently, at inlet end 126 and outlet end 128, internal surface 124 may be coplanar with internal surface 127 of conduit 116.

In various embodiments, internal surface 124 of inline aspirator 120 may be configured to generate a Venturi effect proximate an air outlet 131 of orifices 130. For example, internal surface 124 comprises a constricted section or "choke" 134, a convergent section 136 upstream of choke 134, and a divergent section 138 downstream of choke 134. Choke 134 is the section of internal surface 124 having the smallest diameter D1. Air outlets 131 of orifices may be located immediately downstream of choke 134, for example, in various embodiments, air outlets 131 may be located at the transition from choke 134 to divergent section 138. An inlet area 140, defined by internal surface 124 and having a diameter D2, is located upstream of convergent section 136. Diameter D2 is greater than diameter D1, such that in convergent section 136, the diameter of internal surface 124 decreases from diameter D2 to diameter D1. In various embodiments, diameter D2 may be constant through inlet area 140. An outlet area 142, defined by internal surface 124 and having a diameter D3, is located downstream of divergent section 138. Diameter D3 is greater than diameter D1, such that in divergent section 138, the diameter of internal surface 124 increases from diameter D1 to diameter D3. In various embodiments, diameter D3 may be constant through outlet area 142. In various embodiments, diameter D2 may be equal to diameter D3. In various embodiments, diameter D2 may be between 0.5 inches and 2 inches (1.27 cm and 5.08 cm). In various embodiments, diameter D2 may be between 0.75 inches and 1.5 inches (1.91 cm and 3.81 cm). In various embodiments, diameter D2 may be approximately 1.0 inch (2.54 cm). As used in the previous context, the term "approximately" means ±0.125 inches (±0.318 cm). A slope of internal surface 124 in convergent section 136 may be greater than a slope of internal surface 124 in divergent section 138. Stated differently, in convergent section 136, an angle theta ($\theta$) of internal surface 124 relative to central axis X-X is greater than an angle beta ($\beta$) of internal surface 124 relative to central axis X-X in divergent section 138.

The Venturi effect created by internal surface 124 may increase a flow velocity of primary gas G proximate air outlet 131 of orifices 130. The velocity immediately downstream of choke 134 may increase the flow of ambient air A through orifices 130 and the flow velocity of the primary gas G and ambient air A mixture exiting inline aspirator 120A. For example, a velocity of primary gas G is greatest in area 144, immediately downstream of choke 134. Ambient air A flows through orifices 130 and mixes with primary gas G proximate to area 144. As the diameter of internal surface 124 increases in divergent section 138, the flow velocity of the primary gas G and ambient air A mixture decreases, such that the flow velocity in area 146 is less than the flow velocity in area 144, and the flow velocity in outlet area 142 is less than the flow velocity in area 144. However, the addition of ambient air A in combination with the Venturi effect tends to cause the flow velocity in outlet area 142 to be greater than the flow velocity in inlet area 140. Table 1 illustrates flow measurements at various locations along an inline aspirator 120.

TABLE 1

| Location of Measurement | Inlet End 126 | Air Outlet 131 of Orifice 130 | Outlet End 128 |
|---|---|---|---|
| Area | 0.00536 $ft^2$ (4.9796 $cm^2$) | 0.0101963 $ft^2$ (9.4756 $cm^2$) | 0.00536 $ft^2$ (4.9796 $cm^2$) |
| Density | 0.07647 $lb/ft^3$ (12.2493 $kg/m^3$) | 0.07647 $lb/ft^3$ (12.2493 $kg/m^3$) | 0.07647 $lb/ft^3$ (12.2493 $kg/m^3$) |
| Velocity | 146.67 $ft^3/s$ (4.15 $m^3/s$) | 46.80 $ft^3/s$ (1.38 $m^3/s$) | 234.88 $ft^3/s$ (6.65 $m^3/s$) |
| Volumetric Flowrate | 0.787 $ft^3/s$ (0.022 $m^3/s$) | 0.478 $ft^3/s$ (0.014 $m^3/s$) | 1.260 $ft^3/s$ (0.036 $m^3/s$) |
| Mass Flowrate | 0.0602 lb/s (0.0273 kg/s) | 0.0365 lb/s (0.0166 kg/s) | 0.0964 lb/s (0.0437 kg/s) |

An inline aspirator 120 having the parameters listed in Table 1, exhibits a flow increase of 60.1% with an ambient air to primary gas ratio of 0.607. The increase in flow may allow for smaller charge cylinders, which can reduce overall weight and volume of the life raft assembly 100 of FIG. 1.

Figure 5A:
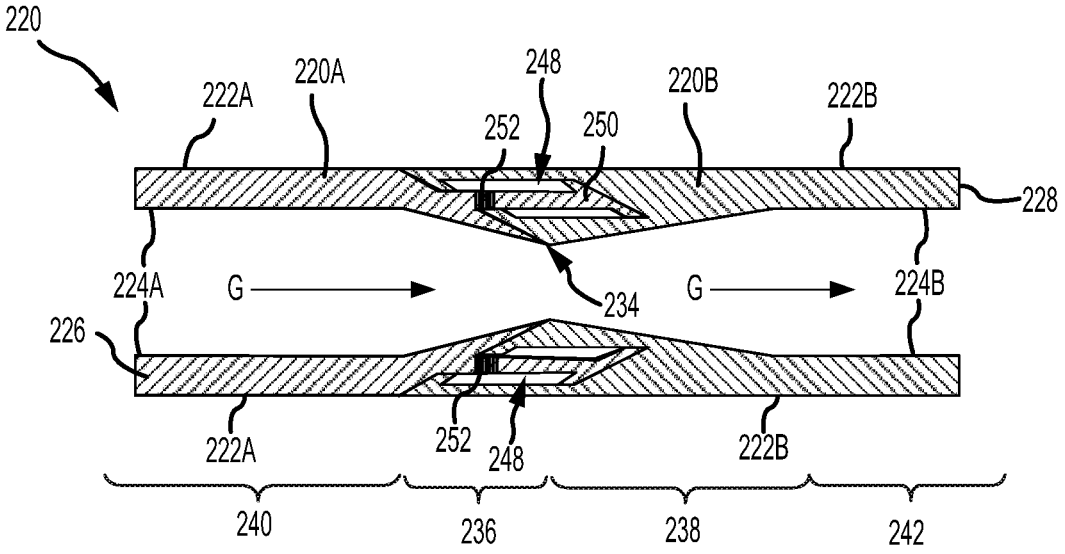
FIG. 5A illustrates an inline aspirator, having a spring loaded orifice, in a closed position, in accordance with various embodiments.

With reference to FIG. 5A, an inline aspirator 220 in a closed position is illustrated, in accordance with various embodiments. In various embodiments, life raft assembly 100 of FIG. 1 may include one or more inline aspirator(s) 220 in place of inline aspirators 120. Inline aspirator 220 includes a first portion 220A and a second portion 220B. First portion 220A and second portion 220B each include, respectively, an external surface 222A, 222B, and an internal surface 224A, 224B.

Internal surfaces 224A, 224B define a gas flow path through inline aspirator 220. Internal surfaces 224A, 224B may be configured to generate a Venturi effect through inline aspirator 220. For example, internal surfaces 224A, 224B may meet to form a constricted section or "choke" 234. Internal surface 224A may define convergent section 236 upstream of choke 234, and internal surface 224B may define a divergent section 238 downstream of choke 234. An inlet area 240, defined by internal surface 224A and which may have a constant diameter, is located upstream of convergent section 236. An outlet area 242, defined by internal surface 224B and which may have a constant diameter, is located downstream of divergent section 238.

In various embodiments, second portion 220B may define a cavity or volume 248. Volume 248 may house a stopper 250 connected to first portion 220A. In various embodiments, first portion 220A may define volume 248, and second portion 220B may include stopper 250 A spring 252, or other biasing member, may be coupled between first portion 220A and second portion 220B. Spring 252 may be configured to bias first portion 220A toward second portion 220B.

Figure 5B:
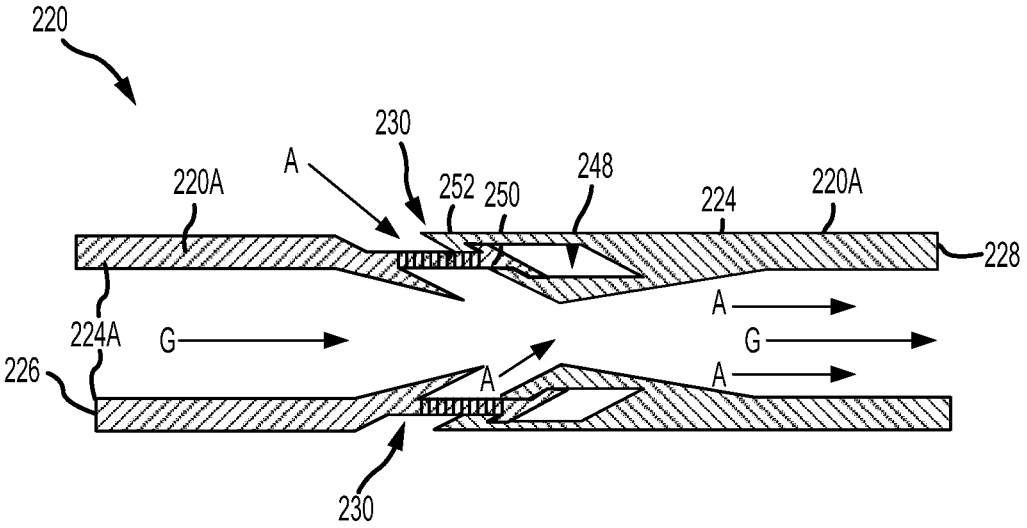
FIG. 5B illustrates an inline aspirator, having a spring loaded orifice, in an open position, in accordance with various embodiments.

With reference to FIG. 5B, inline aspirator 220 is illustrated in an open position, in accordance with various embodiments. In various embodiments, the force of primary gas G flowing through inline aspirator 220 may exceed the spring force of spring 252 and may cause second portion 220B to translate away from first portion 220A. Translation of second portion 220B away from first portion 220A may create and/or expose orifices 230 between first portion 220A and second portion 220B. Ambient air A may flow through orifices 230 and mix with primary gas G down stream of choke 234.

In various embodiments, with combined reference to FIG. 1 and FIG. 5B, upon initial deployment of inflatable structure 102 (i.e., when charge cylinder 110 is full), primary gas G will rush at an increased velocity into inflatable border tubes 114A, 114B. The velocity of primary gas G at initial deployment may cause inline aspirator 220 to open and expose orifices 230. In various embodiments, stopper 250 may contact second portion 220B to prevent inline aspirator 220 from translating beyond a predetermined distance, and reduce the force experienced by spring 252. As the flow velocity of primary gas G decreases (i.e., as charge cylinder 110 empties), the force causing inline aspirator 220 to stay open will decrease, thereby causing spring 252 to bias first portion 220A toward second portion 220B and close inline aspirator 220. Configuring inline aspirator 220 to open and close based on the flow of primary gas G through inline aspirator 220 may reduce occurrences of primary gas G escaping inline aspirator 220 through orifices 230. Reducing occurrences of primary gas escape can increase inflation efficiency of life raft assembly 100.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to invoke 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An inline aspirator for an inflatable assembly, comprising:

a first end defining a primary gas inlet;

a second end defining a primary gas outlet;

an internal surface defining a flow path extending from the primary gas inlet to the primary gas outlet, wherein the internal surface is oriented toward a central axis extending from the primary gas inlet to the primary gas outlet;

an external surface opposite the internal surface, wherein the external surface is oriented away from the central axis; and an orifice located between the first end and the second end and extending from the internal surface to the external surface, wherein the orifice is defined, at least partially, by a radial wall extending from the internal surface to the external surface, and wherein the radial wall is sloped such that a radially outward portion of the radial wall is located closer to the primary gas inlet as compared to a radially inward portion of the radial wall, and wherein an inlet of the orifice is defined by the external surface and an outlet of the orifice is defined by the internal surface.

2. The inline aspirator of claim 1, wherein a slope of the radial wall is configured such that ambient air flowing through the orifice enters the flow path in a streamwise direction.

3. The inline aspirator of claim 2, wherein the internal surface defines a choke, a convergent section upstream of the choke, and a divergent section downstream of the choke.

4. The inline aspirator of claim 3, wherein a first diameter of the internal surface upstream of the convergent section is equal to a second diameter of the internal surface downstream of the divergent section.

5. The inline aspirator of claim 4, wherein the outlet of the orifice is located proximate the choke.

6. The inline aspirator claim 5, wherein the outlet of the orifice is located at a transition from the choke to the divergent section.

7. The inline aspirator of claim 3, wherein in the convergent section, the internal surface is oriented at a first angle relative to the central axis of the inline aspirator, and wherein in the divergent section, the internal surface is oriented at a second angle relative to the central axis, the first angle being greater than the second angle.

8. The inline aspirator of claim 1, wherein at least one of the internal surface or the external surface defines a threading proximate the primary gas inlet.

9. A life raft assembly, comprising:

an inflatable raft;

a conduit fluidly coupled to the inflatable raft;

a charge cylinder fluidly coupled to the conduit; and an inline aspirator located between a first portion of the conduit and a second portion of the conduit, the inline aspirator including:

a first end fluidly coupled to the first portion of the conduit and defining a primary gas inlet;

a second end fluidly coupled to the second portion of the conduit and defining a primary gas outlet;

an internal surface defining a flow path extending from the primary gas inlet to the primary gas outlet, wherein the internal surface is oriented toward a central axis extending from the primary gas inlet to the primary gas outlet;

an external surface opposite the internal surface, wherein the external surface is oriented away from the central axis; and an orifice located between the first end and the second end and extending from the internal surface to the external surface, wherein the orifice is defined, at least partially, by a radial wall extending from the internal surface to the external surface, and wherein the radial wall is sloped such that a radially outward portion of the radial wall is located closer to the primary gas inlet as compared to a radially inward portion of the radial wall, and wherein an inlet of the orifice is defined by the external surface and an outlet of the orifice is defined by the internal surface.

10. The life raft assembly of claim 9, wherein the internal surface defines a choke, a convergent section upstream of the choke, and a divergent section downstream of the choke.

11. The life raft assembly of claim 10, wherein the outlet of the orifice is located downstream of the choke.

12. The life raft assembly of claim 11, wherein the outlet of the orifice is located at a transition from the choke to the divergent section.

13. The life raft assembly of claim 10, wherein in the convergent section, the internal surface is oriented at a first angle relative to the central axis of the inline aspirator, and wherein in the divergent section, the internal surface is oriented at a second angle relative to the central axis, the first angle being greater than the second angle.

14. The life raft assembly of claim 13, wherein a slope of the radial wall is configured such that ambient air flowing through the orifice enters the flow path in a streamwise direction.

15. An inflatable assembly, comprising:

an inflatable structure;

a charge cylinder fluidly coupled to the inflatable structure; and an inline aspirator fluidly coupled between the inflatable structure and the charge cylinder, the inline aspirator including:

a first end fluidly defining a primary gas inlet;

a second end defining a primary gas outlet;

an internal surface defining a flow path extending from the primary gas inlet to the primary gas outlet, wherein the internal surface is oriented toward a central axis extending from the primary gas inlet to the primary gas outlet;

an external surface opposite the internal surface, wherein the external surface is oriented away from the central axis; and an orifice located between the first end and the second end and extending from the internal surface to the external surface, wherein the orifice is defined, at least partially, by a radial wall extending from the internal surface to the external surface, and wherein the radial wall is sloped such that a radially outward portion of the radial wall is located closer to the primary gas inlet as compared to a radially inward portion of the radial wall, and wherein an inlet of the orifice is defined by the external surface and an outlet of the orifice is defined by the internal surface.

16. The inflatable assembly of claim 15, wherein the internal surface defines a convergent section and a divergent section.

17. The inflatable assembly of claim 16, wherein the outlet of the orifice is located at a transition to the divergent section.

18. The inflatable assembly of claim 15, wherein a slope of the radial wall is configured such that ambient air flowing through the orifice enters the flow path in a streamwise direction.

* * * * *